United States Patent [19]

Mochizuki

[11] Patent Number: 4,912,858

[45] Date of Patent: Apr. 3, 1990

[54] FOOTWEAR

[75] Inventor: Hideto Mochizuki, 79, Fukadadai, Yokosuka-si, Kanagawa 238, Japan

[73] Assignees: Hideto Mochizuki, Kanagawa; Michiei Ohkubo, Shizuoka, both of Japan

[21] Appl. No.: 320,308

[22] PCT Filed: Jun. 29, 1987

[86] PCT No.: PCT/JP87/00437

§ 371 Date: Feb. 27, 1989

§ 102(e) Date: Feb. 27, 1989

[87] PCT Pub. No.: WO89/00016

PCT Pub. Date: Jan. 12, 1989

[51] Int. Cl.[4] ..... A43B 7/06

[52] U.S. Cl. ..... 36/3 B

[58] Field of Search ..... 36/3 R, 3 B, 29; 128/588

[56] References Cited

U.S. PATENT DOCUMENTS

| | | | |
|---|---|---|---|
| 1,962,822 | 6/1936 | Krakou | 36/3 B |
| 2,720,041 | 10/1955 | Kajtar | 36/3 B |

FOREIGN PATENT DOCUMENTS

| | | | |
|---|---|---|---|
| 778170 | 9/1939 | France | 36/3 R |
| 266407 | 7/1929 | Italy | 36/3 B |
| 528103 | 12/1957 | Italy | 36/3 B |
| 5440744 | 3/1979 | Japan . | |
| 5440745 | 3/1979 | Japan . | |
| 55129002 | 9/1980 | Japan . | |

OTHER PUBLICATIONS

Japan Patent Application 54–40744, Goromayo An Air Permeable Sole, Mar. 17, 1979.

Japan Patent Application 54–40745, Keijiro Suzuki--Shoes with an Air Permeable Channel, Mar. 17, 1989.

Japan Patent Application 55–129002, Shigeo Kojima–A Sole Which Prevents Moisture, Sep. 11, 1980.

*Primary Examiner*—Paul T. Sewell

*Assistant Examiner*—Andrew D. Meyers

*Attorney, Agent, or Firm*—Oblon, Spivak, McClelland, Maier & Neustadt

[57] ABSTRACT

Footwear comprises a sole consisting of upper and lower members (2, 3) bonded together. The upper member 2 has a plurality of holes 4 penetrating it. The lower member 3 has the top formed with grooves 5 each having a stem 6 communicating with each hole and an end 7 open on the side of the lower member. The top of the upper member communicates with the side of the lower member through ventilation holes 8 consisting of the holes 4 and grooves 5.

3 Claims, 1 Drawing Sheet

FOOTWEAR

FIELD OF THE INVENTION

This invention relates to footwear which has a plurality of ventilation holes formed in the sole for greatly improving ventilation when it is worn.

PRIOR ART

Footwear with a plurality of holes formed in the sole is disclosed in Japanese Utility Model Publication 55-31921, Japanese Utility Model Publication 55-40005, Japanese Utility Model Public Disclosure 55-116504 and Japanese Utility Model Public Disclosure 59-178104.

The footwear disclosed in these publications has an elongate hole or space formed inside the sole, the elongate hole or space being communicated with the top of the sole via longitudinally formed small holes.

With the above construction, the elongate hole or space extends only in the width direction of the sole. Therefore, external air cannot flow through the sole up to the top thereof.

Further, since the small holes are upwardly perpendicular to the elongate hole or space, there is large resistance offered to the passage of external air into the interior of the footwear. Besides, since sand or dust is liable to fill the elongate hole or space extending in the lateral direction, there is a possibility of the hole or space being clogged, which results in the loss of ventilation.

An object of the invention is to provide footwear which eliminates the drawback of the prior art footwear having communication holes, is excellent in ventilation with respect to the interior of the footwear and does not feel uncomfortable when worn.

SUMMARY OF THE INVENTION

According to the invention, there is provided footwear having a sole consisting of at least an upper member and a lower member which are bonded together, the upper member being formed with a plurality of holes penetrating it in the thickness direction, the lower member having its upper surface formed with grooves each having a stem portion communicating with a corresponding one of the holes and an end portion open on the side of the lower member, the end portion of said grooves being deeper than the stem portion, the top of the upper member communicating with the side of the lower member through ventilation holes consisting of the holes and grooves.

BEST MODE FOR WORKING THE INVENTION

Figure 1:
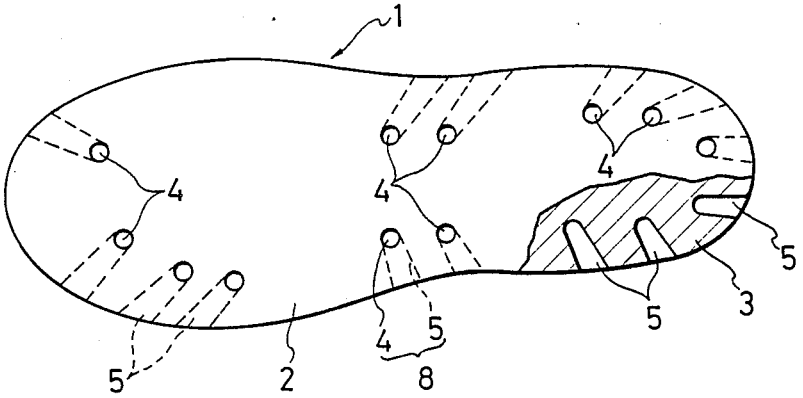
FIG. 1 is a plan view, partly cut away, showing one embodiment of the footwear according to the invention.
Figure 2:
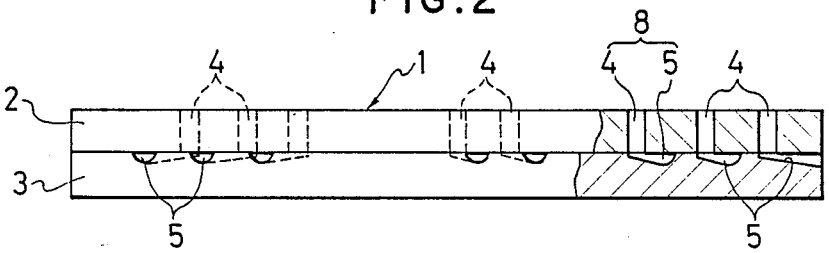
FIG. 2 is a side view, partly broken away, showing the same.
Figure 3:
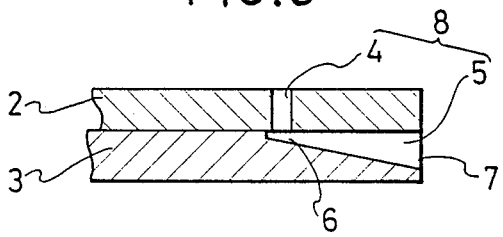
FIG. 3 is a fragmentary sectional view showing the principal part of the same.

The Figures illustrate the inside of footwear, particularly a sole 1. The sole 1 consists of upper and lower members 2 and 3 which are bonded together by an adhesive or the like. The upper and lower members 2 and 3 consist of rubber, foamed synthetic resin, leather, etc. The upper member 2 has a plurality of holes 4 penetrating it in the thickness direction.

It is desired to form the holes 4 at positions not in contact with the sole of the wearer, i.e., spaces between toes, portions surrounding the heel and the arch of the foot.

The top of the lower member 3 is formed with grooves 5 in correspondence to the holes 4. The grooves 5 extend radially from their stems open at the top surface of the lower member 3 toward the edge thereof. The grooves 5 are inclined such that their stems 6 are shallow and their ends 7 are deep. If necessary, the end 7 may be broader than the stem 6.

The grooves 5 are each formed for each of the holes 4 of the upper member 2. When the upper and lower members 2 and 3 are applied together, the lower end of each hole 4 communicates with the stem 6 of the corresponding groove 5, and a ventilation hole 8 is constituted by the hole 4 and groove 5. The top of the upper member 2 communicates through the ventilation holes 8 with the sides of the sole 1 and thence with the atmosphere. The space of the ventilation hole 8 becomes narrower inwardly from the open end on the side of the sole 1 by the presence of the groove 5.

The groove 5 is desirably inclined not in the lateral direction of the lower member 3 but in a direction toward the toe or heel side. The groove 5 positioned on the side of the lower member 3 is inclined toward the toe or heel side, and the groove 5 positioned on the toe or heel side is directed toward the front end of the toe or rear end of the heel.

A cover is provided around the sole 1 having the above construction to obtain the footwear. The footwear has a plurality of ventilation holes 8 which are bent and extend from the sides of the sole 1 to the top surface of the upper member 2, and the ventilation holes 8 are inclined to provide less resistance against the flow of external air. Thus, flow of external air into the inside of the footwear from the ventilation holes 8 is greatly facilitated, and when the footwear is worn, external air is forcibly passed through its interior as it moves through the air with the movement of the foot.

When the wearer runs, the heat radiation from the foot is increased in addition to the generation of heat of friction between the foot and footwear and heat of friction with repetition of the deformation of the footwear. Simultaneously, however, the effect of the movement of the footwear through the air also increases. Thus, external air flows into the interior of the footwear in correspondence to the running speed. Further, the ventilation hole 8 becomes narrower from the open end of the sole 1. Thus, the flow of air entering from the open ends during passage of the footwear through the air is accelerated as it passes through the ventilation holes 8 which become gradually narrower. As a result, it applies certain atmospheric pressure to the interior of the footwear. Thus, the footwear feels comfortable.

Further, sand or dust entering the ventilation holes 8 can slip down because the grooves are downwardly inclined toward the open end and will not be collected in the inside of the ventilation holes 8, so that the ventilation effect is not degraded.

Further, the grooves 5 of the ventilation holes 8 become shallower inwardly from the open end. This means that the portion of the sole 1 to which the weight of the user is applied when the footwear is worn is thicker. Thus, when the body weight is received when the footwear is worn, the ventilation holes 8 are not crushed, and the comfortableness is not degraded.

At the time of the manufacture, the upper member 2 having the holes 4 and lower member 3 having the grooves 5 are formed separately and are joined together with an adhesive, whereby the ventilation holes 8 can be constituted without need for special boring and cutting processes, so that the footwear can be mass-produced very easily and inexpensively by the widespread molding process.

Figure 4:
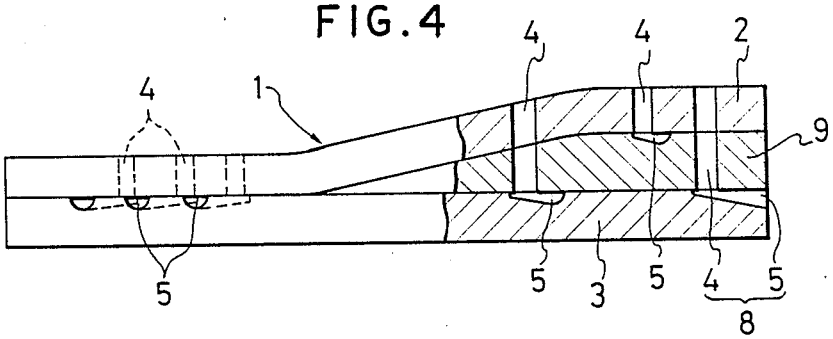
FIG. 4 is a side view, partly broken away, showing a different embodiment of the footwear according to the invention.

FIG. 4 shows a different embodiment of the invention. In this instance, the height of the heel portion of the sole 1 is increased with an intermediate member 9 provided between the upper and lower members 2 and 3. The ventilation holes 8 in the heel portion of the sole 1 may consist of the holes 4 formed in the upper member 2 and grooves 5 formed in the top surface of the intermediate member 9 or consist of holes 4 formed in the upper and intermediate members 2 and 9 and grooves 5 formed in top of the lower member 3.

As has been shown, even where the ventilation holes 8 penetrate the intermediate member 9 of the sole 1 it is possible to obtain the same effect as in the preceding embodiment.

INDUSTRIAL APPLICABILITY

As has been described in the foregoing, with the provision of a unique structure of ventilation holes in the sole it is possible to provide very satisfactory ventilation and prevent air stagnation and odor generation. Further, the footwear can be worn comfortably. It is thus possible to provide footwear having high utility not only for physical exercise but for general purposes.

What is claimed is:

1. Footwear having a sole consisting of at least an upper member and a lower member which are bonded together, said upper member being formed with a plurality of holes penetrating it in the thickness direction, said lower member having its upper surface formed with grooves each having a stem portion communicating with a corresponding one of said holes and an end portion open on the side of said lower member, said end portion of said grooves being deeper than said stem portion, the top of said upper member communicating with the side of said lower member through ventilation holes consisting of said holes and grooves.

2. The footwear according to claim 1, wherein said ventilation holes become inwardly narrower from the end portion toward the stem portion of said grooves.

3. The footwear according to claim 1, wherein said plurality of holes are formed at positions not in contact with the sole of the wearer's foot.

* * * * *